US006379058B1

(12) United States Patent
Petteruti et al.

(10) Patent No.: US 6,379,058 B1
(45) Date of Patent: Apr. 30, 2002

(54) SYSTEM FOR RF COMMUNICATION BETWEEN A HOST AND A PORTABLE PRINTER

(75) Inventors: Steven F. Petteruti; Majid Amani, both of East Greenwich; Robert Hoen, Warwick, all of RI (US)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 09/539,118

(22) Filed: Mar. 30, 2000

(51) Int. Cl.[7] ..... B41J 3/36

(52) U.S. Cl. ..... 400/76; 400/88; 400/70; 400/61

(58) Field of Search ..... 400/76, 70, 61, 400/88

(56) References Cited

U.S. PATENT DOCUMENTS

| | | | | | |
|---|---|---|---|---|---|
| 4,734,710 | A | * | 3/1988 | Sato et al. | 346/76 |
| 5,267,800 | A | | 12/1993 | Petteruti et al. | |
| 5,503,483 | A | | 4/1996 | Petteruti et al. | |
| 5,520,470 | A | | 5/1996 | Willett | |
| 5,524,185 | A | | 6/1996 | Na | |
| 5,555,351 | A | * | 9/1996 | Craig et al. | 395/114 |
| 5,696,499 | A | | 12/1997 | Mitsuhashi et al. | |
| 5,726,431 | A | * | 3/1998 | VanDonkelaar et al. | 235/383 |
| 5,805,807 | A | * | 9/1998 | Hanson et al. | 395/200.09 |
| 5,806,993 | A | | 9/1998 | Petterutti et al. | |
| 5,997,193 | A | | 12/1999 | Petterutti et al. | |
| 6,004,053 | A | | 12/1999 | Petteruti et al. | |
| 6,010,257 | A | | 1/2000 | Petteruti et al. | |
| 6,163,538 | A | * | 12/2000 | Brown et al. | 370/389 |
| 6,192,400 | B1 | * | 2/2001 | Hanson et al. | 709/217 |

* cited by examiner

*Primary Examiner*—John S. Hilten
*Assistant Examiner*—Charles H. Nolan, Jr.
(74) *Attorney, Agent, or Firm*—Kenneth J. LuKacher

(57) ABSTRACT

A system is provided for RF communication between a host terminal or computer system ("host") and a portable printer through RF signal transmissions. The host has a RF communication interface and is programmed to send and receive data via the interface to a portable printer. The portable printer has a printing mechanism for printing on media and a RF communication interface to send and receive data from a host. The printer is programmed to link with a host and then operate responsive to data received in RF signals from a host linked to the printer. Each portable printer has a unique serial number which is recorded in a barcode present on the housing of the printer and/or in an RFID tag coupled to the printer. The host has either, or both, an optical scanner or an RFID transmitter/receiver to read the printer's barcode or RF signals from the tag to obtain the printer's serial number. The host uses the serial number to identify a unique address associated with the printer by association between printer serial numbers and addresses. The host and printer are linked for RF communication by the host sending a first packet addressed to the printer utilizing the printer's address, the printer sending a second packet in response to the host, and the host sending a third packet directing the printer that it is linked to the host by the host's unique address for subsequent data communication there between, such that the printer responds to packets of data (commands and data) received from the host having the host's address. Other hosts can be similarly linked to the printer, such that when each of the hosts are linked to the printer, the printer is responsive to the linked host. Before the printer or the host sends a packet in a RF transmission, the printer or host may first find a clear channel for such transmission. The system may be used with multiple hosts and portable printers, such that different hosts can be linked to different printers.

25 Claims, 14 Drawing Sheets

SYSTEM FOR RF COMMUNICATION BETWEEN A HOST AND A PORTABLE PRINTER

DESCRIPTION

Field of the Invention

The present invention is related to a system (and method) for RF communication between a host, such as a host computer system or terminal, and a portable printer, and relates particularly to, a system for RF communication between a host and a portable printer by linking the printer to the host to provide RF communication there between, such that the printer operates responsive to the linked host. The present invention is suitable for use in environments where multiple portable printers and host devices are present to enable different hosts and printers to be linked for communication with each other, where each printer operates to print information received from a linked host on media contained in the printer.

BACKGROUND OF THE INVENTION

Miniature portable printers have been used on factory floors, in warehouses, and in retail establishments for ticket printing and inventory control. For example, such portable label printers are described in U.S. Pat. Nos. 5,806,993, and 5,267,800. These printers print indicia, such as text or bar codes, on media, such as adhesive-back label stock or paper, from a roll in the printer housing. Being miniature, such portable printer are more useful than heavier stationary or briefcase printers, as they are of a small weight and size to be easily can be carried or worn by a user. Each of the printers can interactively communicate with a host terminal or computer system. To change communication with different host terminals or computers (host devices), the user must establish communication with the new host device which often requires the user to manually reset the printer and host via the printer keypad, or to reconnect cabling between the new host device and the printer. This can be time consuming and tedious for the user, and can be difficult when the communication protocol of the host device and the printer are dissimilar. Accordingly, it is desirable to easily link a miniature, portable printer to different ones of host devices, and once linked, can to communicate therewith. This would be especially useful in a retail environment having multiple host devices and portable printers.

SUMMARY OF THE INVENTION

It is the principal object of the present invention to provide an improved system for communication between a host device and a portable printer in which the host and printer can be linked to each other to enable data communication there between by RF signals.

It is another object of the present invention to provide an improved system for data communication by RF signals between a host device and a portable printer in which the host device has either, or both, an optical scanner or RFID tag reader to identify an identifier (such as a serial number) associated with the address of the printer in one of a scanned barcode on the printer housing, a read RFID tag coupled to the printer, or an RF broadcast received from the printer, such that the host can address the printer for linking to the host by the address associated with the scanned, read, or received printer identifier.

It is still another object of the present invention to provide an improved system of data communication by RF signals between a host device and a portable printer in which either one or both the host device and the printer can identify a clear RF communication channel before sending an RF signal transmission.

Yet another object of the present invention is provided an improved system for data communication by RF signals between a host device and a portable printer in which the host device and portable printer are capable of negotiation communication characteristics, such as baud rate and encoding format.

Briefly described, the system includes at least one host terminal or computer system (referred to herein as host or host device) and at least one portable printer. The host device has an RF communication interface and a programmed controller to send and receive data via the interface to the printer. The portable printer has a printing mechanism for printing on media contained in the printer, an RF communication interface, and a programmed controller for controlling the printing mechanism and the RF communication interface responsive to data received from the host. Each portable printer has a unique identifier, such as a serial number, which is recorded in a barcode present on the housing of the printer, and/or in an RFID tag coupled to the printer. The host has either, or both, an optical scanner or an RFID reader to read the printer's barcode, or RF signals from the RFID tag, to obtain the printer's identifier. Utilizing this identifier, the host identifies the unique address of the printer to be linked to the host via an association between printer identifiers and addresses. The host and printer are linked for data communication by the host sending a wakeup packet addressed to the printer, the printer sending to the host a ready packet, the host sends a force link packet identifying the host's unique address to the printer, and the printer then sending to the host an accept link packet indicating that the printer is linked to the host for subsequent data communication there between, in which the printer responds to data received from the host having the host's address.

Other host devices can similarly be linked to the printer, such that when each of the hosts are linked to the printer, the printer is responsive to the linked host. The host and printer may negotiate data communication characteristics, such as baud rate and encoding format, using the wakeup packet and a ready packet during at the start of the data transfer process to enable communication at the highest baud rate and with proper encoding/decoding of data. Before a packet is sent in a RF transmission to either the printer or host, either, or both the printer and host finds a clear channel for such transmission and receipt of a reply to the transmission, and retries the transmission when no reply is received. The system may be used with multiple hosts and portable printers, such that different hosts can be linked to different printers.

In the system, the host device initiates the link to the portable printer, such as described above. However, the printer may also initiate linking with a host device by broadcasting an RF signal with the printer's identifier (or address) in a link request packet. The first host in proximity to the printer, which responds to the link request packet with a successful link procedure, as described above, is then linked to the printer. This embodiment enables a host, which may not have an optical barcode scanning and/or RFID tag reading capability, to be linked to a printer.

BRIEF DESCRIPTION OF THE DRAWINGS

The foregoing objects, features and advantages of the invention will become more apparent from a reading of the following description in connection with the accompanying drawings, in which.

DETAILED DESCRIPTION OF THE INVENTION

Figure 1:
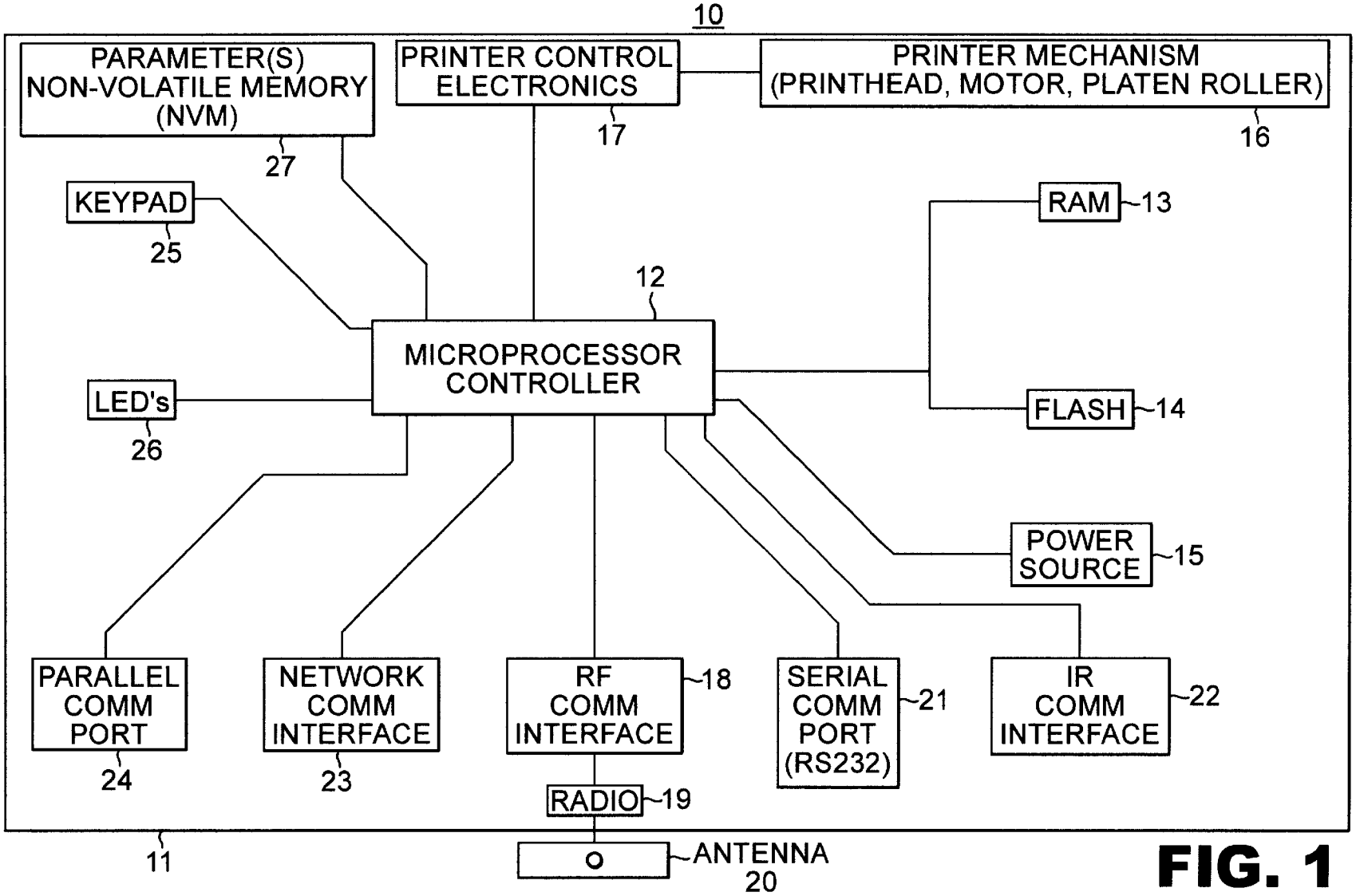
FIG. 1 is a block diagram of the portable printer in the system according to the present invention.
Figure 1A:
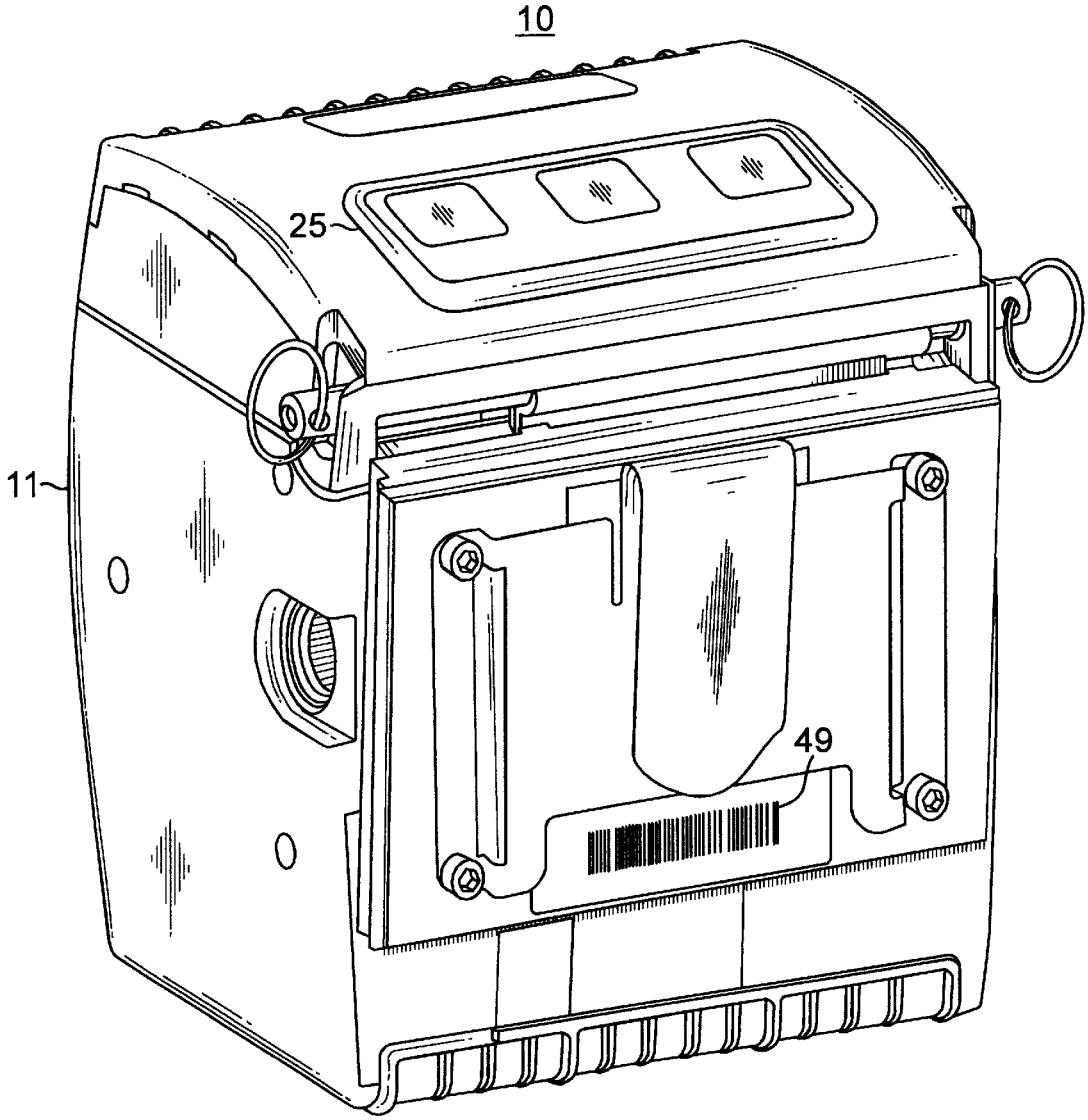
FIG. 1A is a perspective view of an example of the housing of the portable printer of FIG. 1.

Referring to FIG. 1, a block diagram of a portable printer 10 in the system of the present invention is shown having a microprocessor controller 12 operating in accordance with program stored in memory of the microprocessor, RAM 13 or FLASH memory 14. The printer 10 has a printer mechanism 16 controlled by the controller 12, via printer control circuitry 17, to print on media, such as paper or adhesive-backed label stock or paper. The printer mechanism 16 includes a print head and motor for driving a platen roller to advance the media across the print head. The media may be stored in a compartment in the housing wound on a roll. The controller 12 operates responsive to communication received from a host terminal, such as a portable terminal device or host computer system (referred to herein after as host or host device), to send information to the print head to print information on the media. Such information may represent text, graphics, lines, or barcodes. To enable communication with a host terminal, an RF (radio frequency) communication interface 18 with a radio 19 and an antenna 20 is provided in the printer 10. Preferably, the RF communication interface 18 provides short-range radio communication, such as within about 100 feet. The printer 10 may also communicate through a cable to the host terminal through a serial (RS-232) communication port 21, an infrared (IR) communication interface 22, a network LAN interface 23, or a parallel port 24. Other serial communication protocols than RS232 may be used by port 21, and interfaces 22, 23, and port 24 are optional. A keypad (and/or buttons) 25 and LEDs 26 of the printer 10 enable a user to interface with the controller 12. Parameters of printer operation may be stored in non-volatile memory (NVM) 27 accessible by controller 12, such as the printer's unique serial number. A power source 15, such as a battery, supplies power to the controller 12 and other components in the printer. Power from source 15 may be supplied through power management circuitry (not shown) coupled to controller 12 to enable the controller to turn on/off (low power) the printer 10. The printer is contained in a housing 11, which is portable and may be miniature in size. The housing 11, electronics, and printing enabling components of printer 10 may be such as described in the portable printers of U.S. Pat. Nos. 5,806,993, 5,267,800, or 6,005,053, which are herein incorporated by reference. An example of the printer 10 with housing 11 is shown in FIG. 1A, where a barcode 49 may be provided on the back of the housing 11 with the unique serial number associated with the printer. However, any programmable, portable, miniature printer having an RF communication means compatible in frequency with the RF signals of a host may use the present invention. The printer 10 may weight less than about 2.5 pounds and has a volume of less than about 103 cubic inches.

Figure 2:
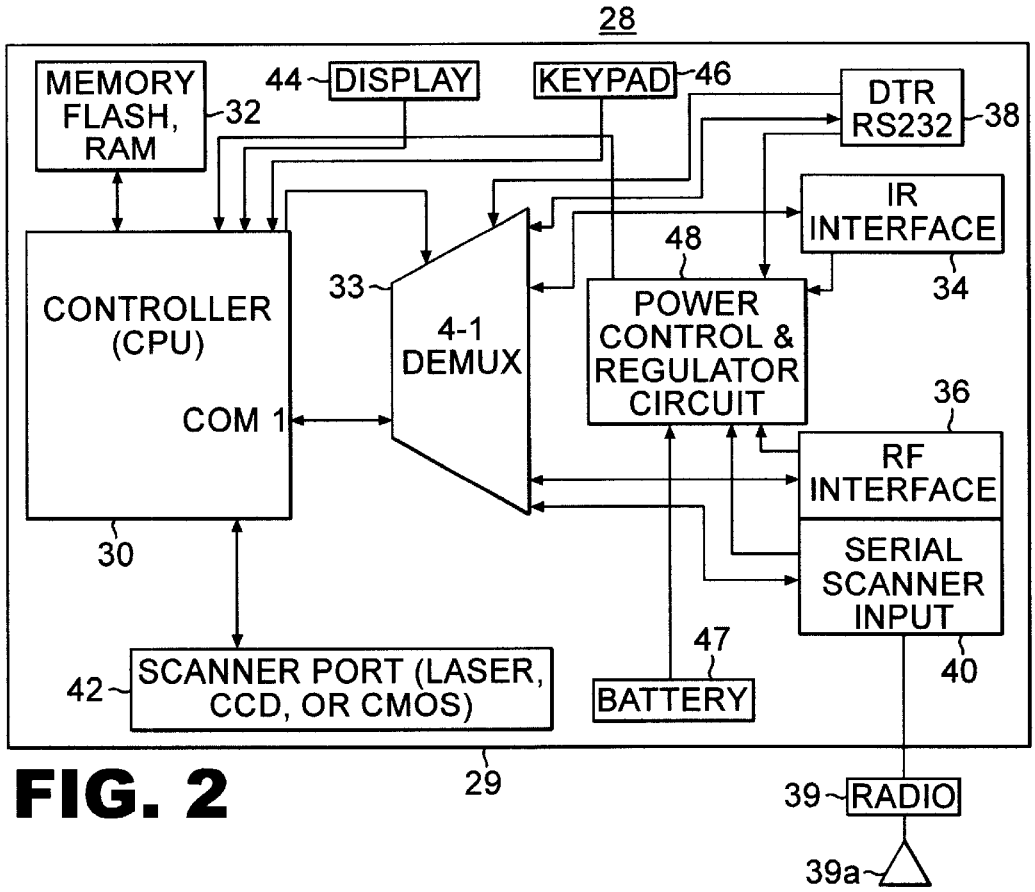
FIG. 2 is a schematic diagram of a terminal host device having an RF interface for communication with the portable printer of FIG. 1 in the system according to the present invention.
Figure 2A:
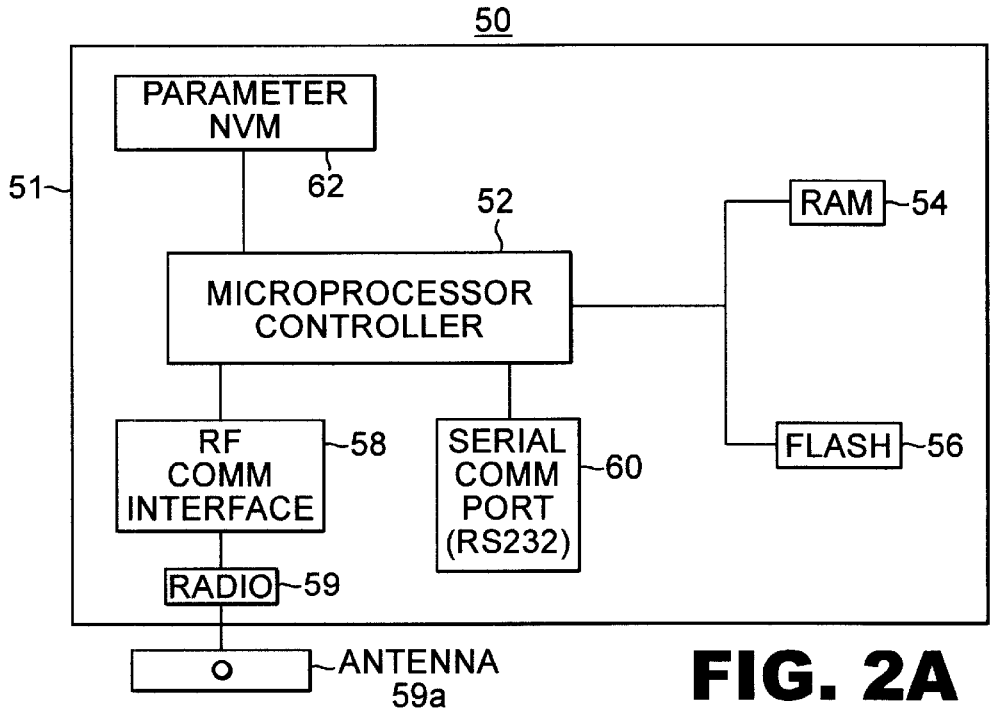
FIG. 2A is an attachment system for a host device to enable RF communication with the portable printer of FIG. 1.

The host device in the system of the present invention may represent any programmable microprocessor-based device having an RF communication interface capable of short range RF communication compatible in frequency with the RF signals from printer 10. The host device may be a portable terminal 28 as shown, for example, in FIG. 2. Terminal 28 has a housing 29 with microprocessor controller 30 operating in accordance with a program in memory of controller or in RAM or FLASH memory 32. The terminal 28 may have multiple communication interfaces interfaced to communication ports of the controller 30, or selectable by the controller via demultiplexer 33 to a single communication port (COM1). These communication interfaces include Infrared (IR) interface 34, RF interface 36 with a radio 39 and an antenna 39*a*, serial (RS-232) interface 38, and serial scanner 40. The programmed controller 30 can link and communicate with a printer, as will be described latter in connection with FIGS. 4–6. The serial scanner 40 represents a typical laser/CCD/CMOS-based scanner either integrated into the terminal 28, or external to the terminal and connected by a cable to an input port of the terminal. The serial scanner 40 is capable of scanning and receiving light representing a barcode, and converting such light into electronic signals, which are decoded by a typical barcode decoding program in the controller 30, or via barcode decoding chip in the terminal. A separate scanner port 42 may also be provided in addition to, or instead of, serial scanner 40, through which an external scanner may be provided. Display 44 and keypad 46 allow the user to interface with the controller 30. A battery 47 (or AC from a coupled adapter) in the terminal 28 supplies power to the controller and other components of the terminal through a power control and regulator circuit 48 to enable the controller 30 to turn on/off (low power) the terminal. If the host represents a computer system such as a personnel computer, an external scanner may be connected to the host computer system via a USB port, serial or parallel port of the computer system to provide scanned barcode data.

If a host device lacks an RF communication interface, or the programming to enable RF communication in accordance with the present invention to printer 10, an RF communication system 50 may be attached to a communication port on the host device. System 50 has a housing 51 with a microprocessor controller 52, which operates in accordance with a program stored in memory of the controller or in RAM 54 or FLASH memory 56 accessible by the controller. Parameters of printer operation may be stored in non-volatile memory 62 accessible by controller 52. The system 50 includes a RF communication interface 58 with a radio 59 and an antenna 59*a* through which the programmed controller 52 can communicate with a printer, as will be described latter in connection with FIGS. 4–6, in response to data received or transmitted from the host via a serial communication port 60. In this manner, system 50 enables a host to be compatible with the data communication provided by the present invention without requiring the host device to be upgraded with additional RF communication interface or programming.

Figure 3:
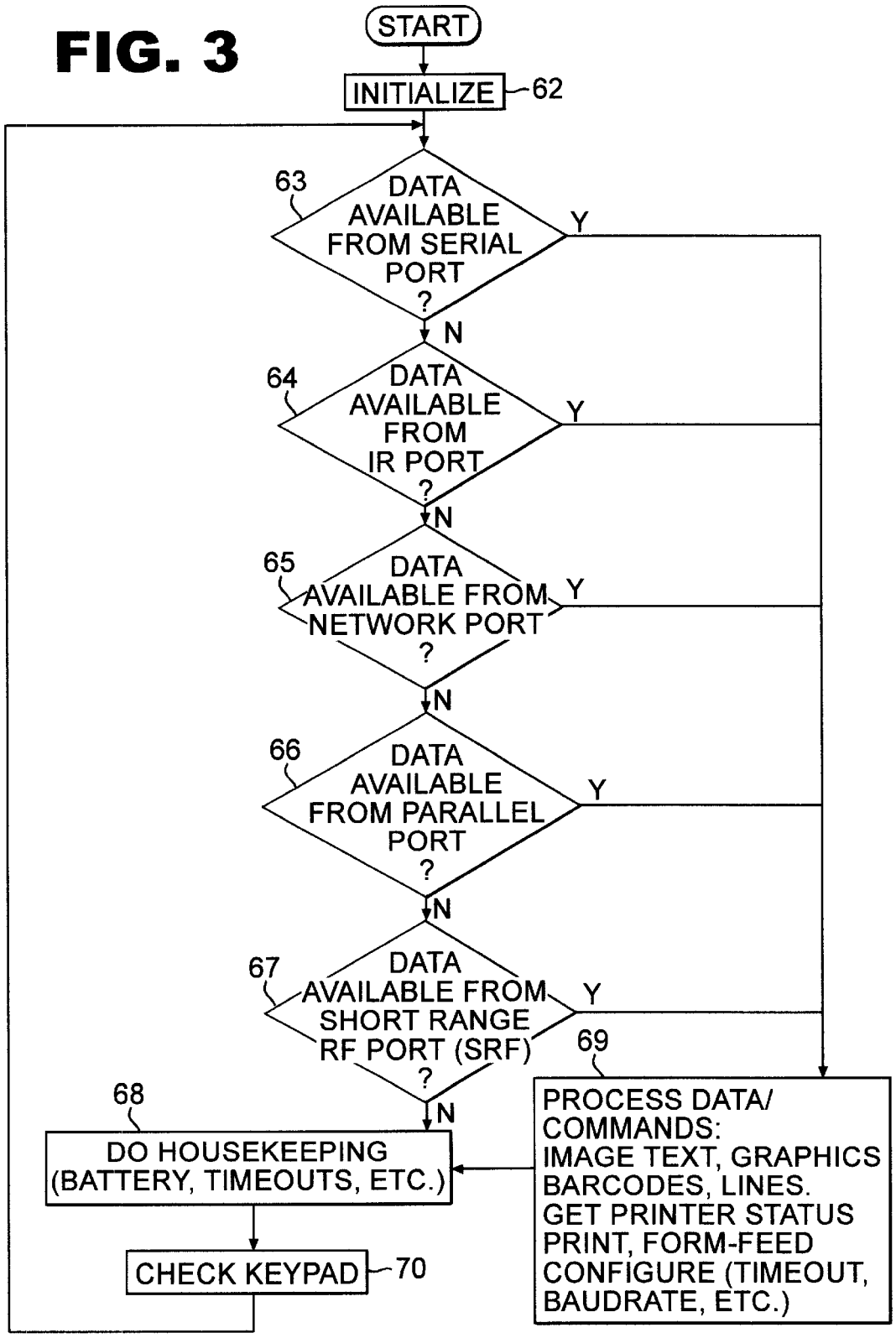
FIG. 3 is a flow chart illustrating the operation and program for the printer of FIG. 1 for receiving data from a host device.

Referring to FIG. 3, a flow chart of the program (software) of the printer controller 12 is shown in which the printer 10 is first initialized after startup to configure the printer mechanism and motor, place the RF communication interface into receive mode, clear the TX (send) and RX (receive) buffers in memory of the printer, and set the communication ports to receive data (step 62). The controller 12 periodically checks for data available at from any of its ports from serial port 21, IR interface 22, network interface 23, parallel port 24, or RF interface 18 (steps 63–67). Such data represents commands and data, such as information to be printed. If the command and data received are valid, the data is processed by controller 12 in accordance with the command (step 69). For example, the controller 12, in response to such commands can: direct the controller to send information to the printer mechanism to print text, graphics, lines, or barcodes; report printer status to the host; or other operations, such as form-feed (actuation of the printer mechanism's motor), or to reconfigure parameters of operation, such as baud rate, or a timeout period of a software timer to determine when after an interval of inactivity the controller 12 should turn the printer off (low power). Periodically, the controller 12 performs other tasks (step 68), such as battery check, and checking for any input from keypad 25 (step 70).

Figure 4:
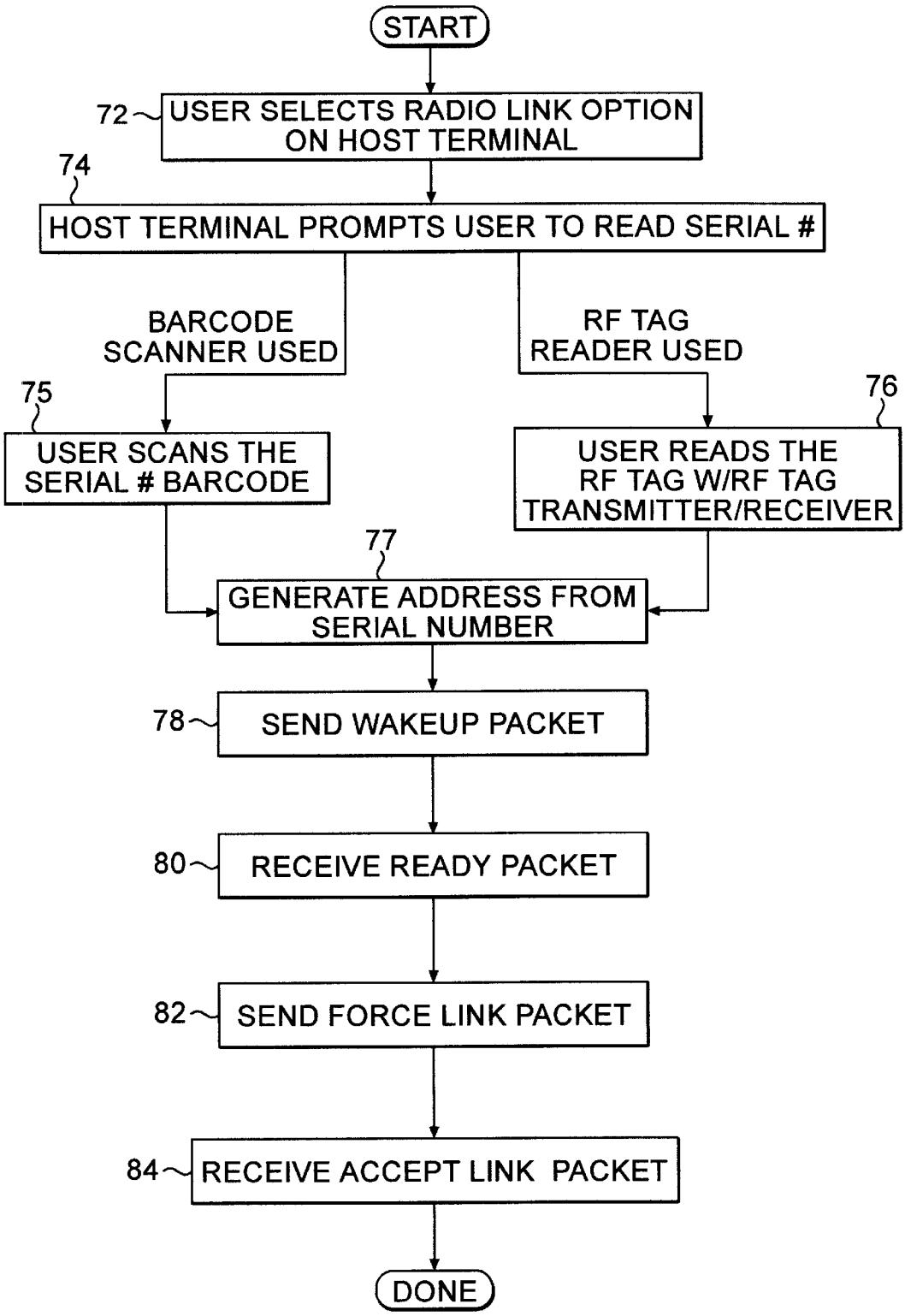
FIG. 4 is a flow chart illustrating the link operation and program in the host device to establish RF communication between the portable printer and host device in the system of the present invention.

Referring to FIG. 4, the process of the host program operating in the controller 30 for linking to a portable printer 10 for subsequent data communication is shown. A user first selects a radio link option on the host terminal via the keypad 46 (step 72). The host terminal 22 then prompts the user to read the serial number of the printer to be linked (step 74). The user positions the host terminal scanner 40 or 42 to scan the serial number when present as a barcode on the housing of the printer 10, such as on a label or printed on the body of printer housing 11 (step 75). For example, a barcode 49 is shown on printer housing 11 in FIG. 1A. Each one of printer 10 in the system of the present invention has a unique serial number. Optionally, the host may have a RFID transmitter/receiver, coupled to its controller 30, such as a read/write RF tag encoder of the TIRIS RF system sold by Texas Instruments. A RF tag may be coupled to the printer housing 11, such as by adhesive, or located in the printer housing, encoded with data representing the printer's serial number. The RF tag can be read by the RFID transmitter/receiver of the host to provide the host with the serial number (step 76). Less preferred, the user may manually input, via the keypad of the host, the serial number of the printer presented along with the barcode on the printer's housing. Once the host receives the serial number of the printer, it uses the serial number to generate the unique address of the printer (step 77). Each one of printers 10 in the system of the present invention also has a unique address. To generate the printer address, a lookup table stored in memory of the host may be used which associates printer serial numbers with printer addresses, or by conversion of one or more parts or values of the serial number into the printer's unique address. Optionally, the serial number may contain the actual address of the printer. The host then sends, via its RF communication interface 36, a wakeup packet, which includes at least the address of the printer as a destination address, and a unique address of the host terminal 28 as a source address (step 78). In response to receiving the wakeup packet, the printer's controller 21 sends a ready packet to the host via the printer's RF communication interface 18 (step 80). The wakeup packet insures that the radio 19 and RF communication interface 18 of the printer are fully powered up and ready to engage in RF linking with the host. The host then sends a force link data packet to the printer via RF communication interface 36 (step 82), and in response, the printer sends an accept link packet via communication interface 18 (step 84).

Figure 4A:
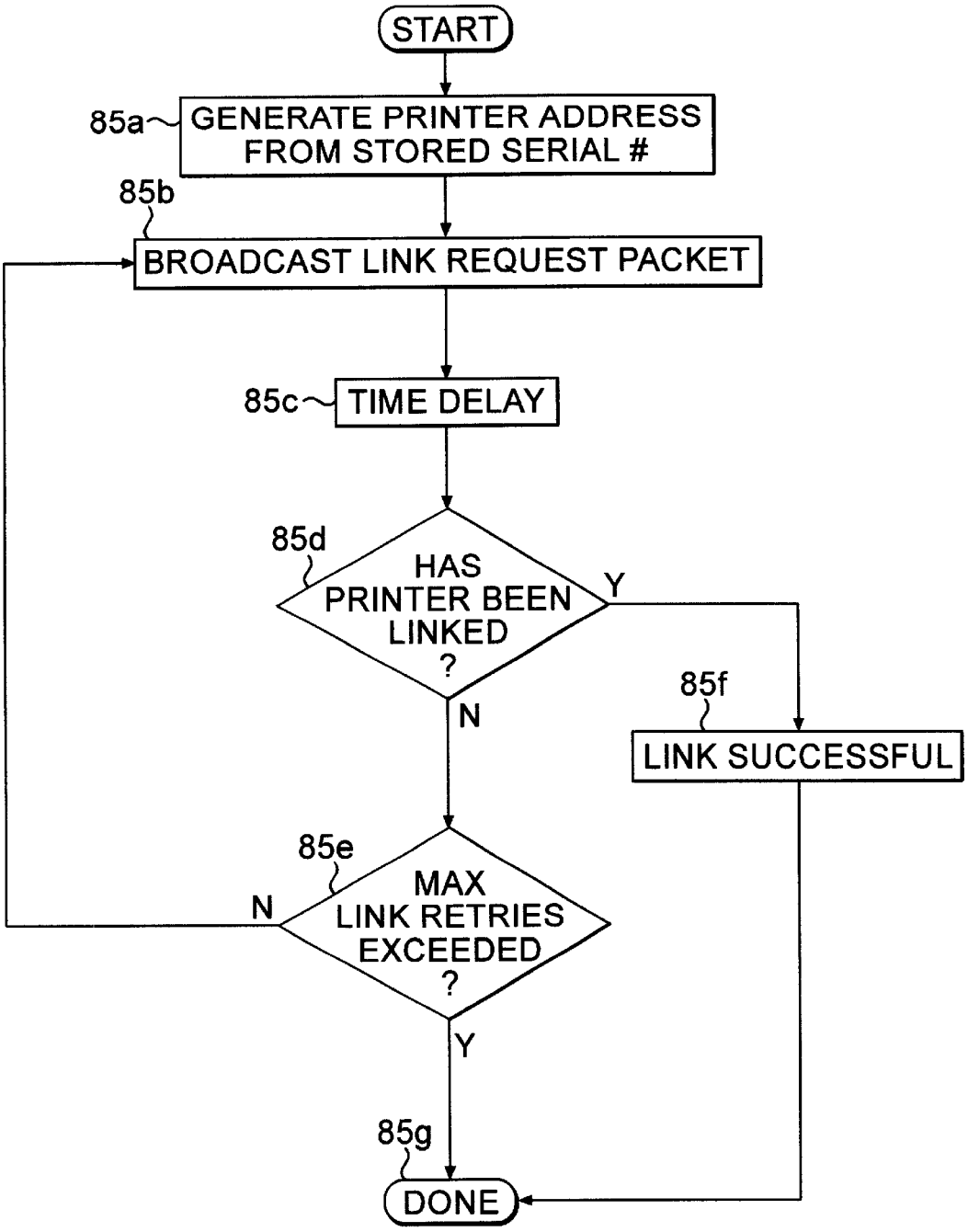
FIG. 4A is a flow chart illustrating the operation and program of the printer of FIG. 1 to broadcast link with a host device.

In addition to the host initialing a link with a printer, the printer may initiate a link with a host as shown in FIG. 4A. In response to the user selecting broadcast link upon the keypad on the printer, the controller 12 of the printer first generates the printer address from the serial number stored in memory of the printer (step 85*a*). The controller 12 then generates a broadcast link request packet, which includes at least the address of the printer (step 85*b*). After a time delay 85*c*, such as about 25 seconds, the controller 12 checks if it has been linked to a host (step 85*d*). If not, it checks if a maximum number of retries has been exceeded (step 85*e*) and rebroadcasts the link request packet (step 85*b*), otherwise, the process ends (step 85*g*). The number of retries may be, for example, three, and is tracked by a variable in memory of the controller incremented each time a retry is attempted. A host operates responsive to receiving a broadcast link request packet, via its RF interface, by sending the force link packet of step 82 of FIG. 4, and the printer in response sending, via its RF interface, an accept link packet of step 84. The printer has been linked with a host at step 85*d* when the printer has received a force link packet and has responded with an accept link packet (step 85*f*). The interactive data communication of the host and printer at steps 78–84 (FIG. 4) is described in more detail in FIGS. 5,5A, and 6 below.

Figure 5:
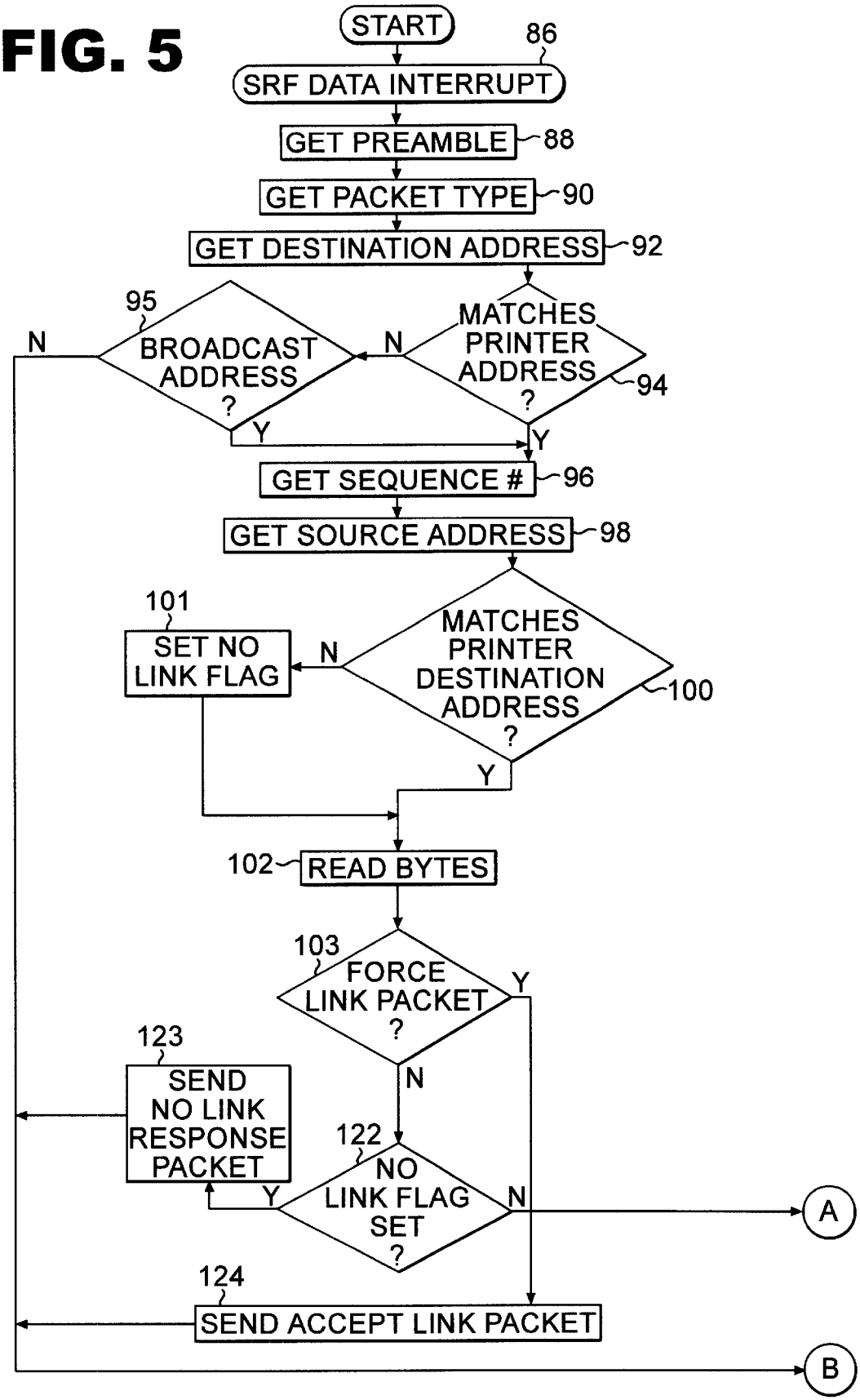
FIGS. 5 and 5A is a flow chart illustrating the operation and program of the portable printer of FIG. 1 to link with a host device and to receive data (commands and data) from the linked host device.
Figure 5A:
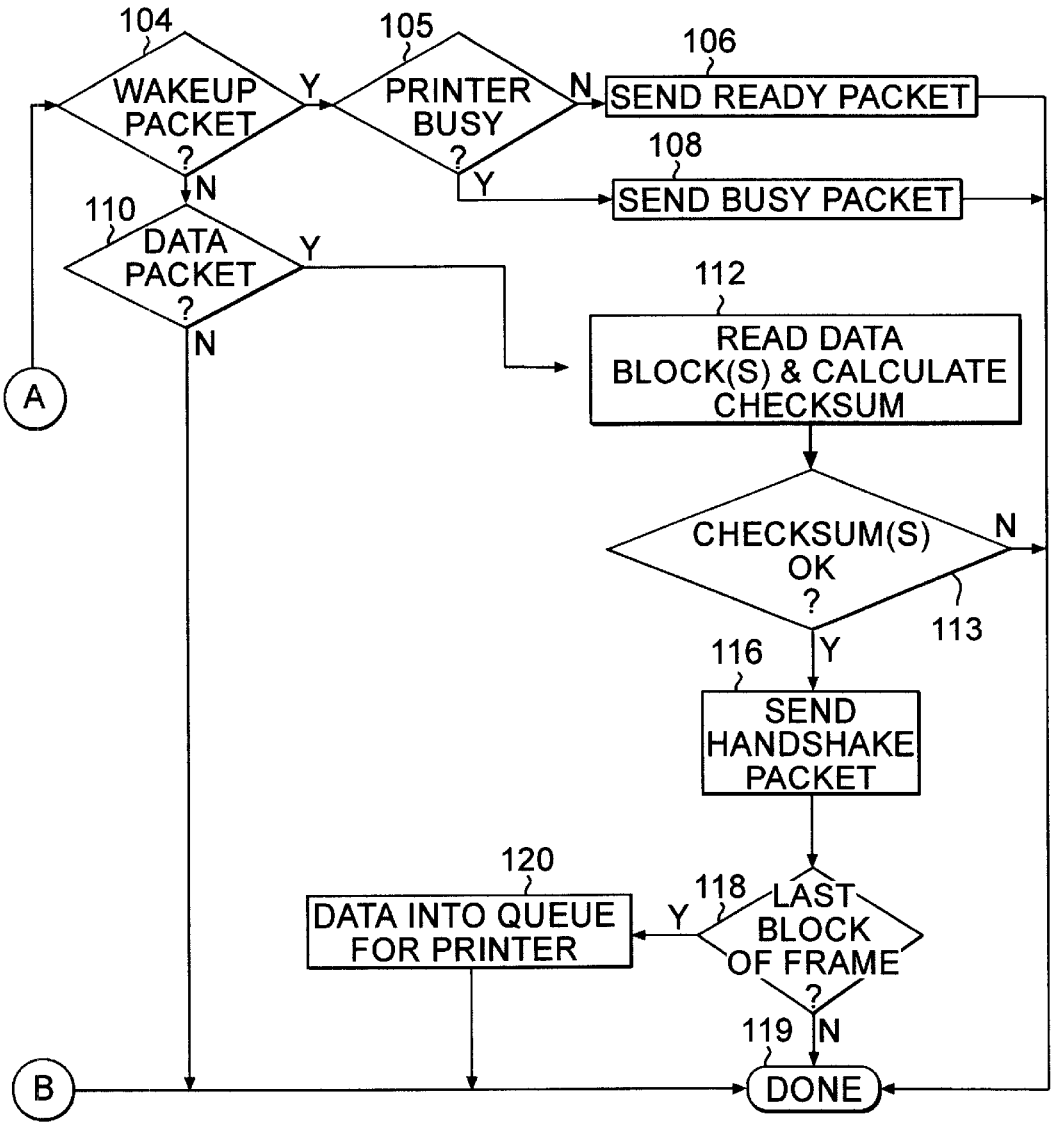

Referring to FIGS. 5 and 5A, the process of the printer program operating in controller 12 for enabling linking to and RF communication with a host is shown. The controller 12 first receives an interrupt when data from the RF interface 18 is received (step 86). The data is formatted in packet having predefined fields which include: a preamble, a packet type, a sequence number, a destination address, a source address, and other fields depending on packet type. There are three types of packets which can be received by the printer from the host: wakeup packet, force link packet, and data packet, as will be described later in more detail. When the packet is a data packet, the packet further includes additional fields, such as one or more data blocks, and a checksum value for the bytes of each data block. The printer can send different types of packets to the host using the same predefined fields, including, a ready packet, an accept link packet, a handshake packet, a no link packet, and a broadcast link request packet. The controller 12 receives the data and reads the preamble (step 88), the packet type (step 90), and the destination address (step 92) of the received packet. The controller 12 then checks if the destination address matches the printer address, which is stored in non-volatile memory 27 of the printer (step 94). If the destination address does not match the printer address, the controller 12 then checks if the destination address matches a broadcast address (step 95). A broadcast address presents one or more of additional addresses stored in non-volatile memory 27 of the printer which the printer is responsive to. Thus, a group of printers having a common broadcast address may respond to the same packet from a host. If the destination address neither matches the printer address or one or more broadcast addresses assigned to the printer, the process ends at step 119. If the destination address is a broadcast address at step 95, or if the destination address matches the printer address at step 94, the controller 12 reads the sequence number (step 96) and the source address (step 98) of the received packet. The sequence number is a unique identifier assigned each packet sent to the printer from the host. The sequence number is used by the printer to differentiate an original (unreceived) packet from a retry (already received) packet. The host sends each new packet with a sequence number incremented from the sequence number of the previous packet sent. When a host retries a packet, such as because it did not receive an expected response from the printer, it resends the packet with the same sequence number as the original. The printer may similarly use sequence numbers in the packets sent to the host.

Next, the controller 12 checks if the source address matches a previously stored destination address associated with the host to which the printer is presently linked. This destination address is stored in RAM 13 of the printer when a force link packet, as later described below, is received by the printer having the unique address of the host. Optionally, the printer may store one or more other destination addresses associated with other hosts in its memory, such that a printer can receive packet from multiple hosts. If the source address does not match the stored destination address at step 100, a no link flag is set in memory of the printer (step 101). The controller 12 then reads the bytes representing the data packet count, if the packet is a data packet, to determine how many data packets are to be received by the printer when the first of such data packets is received (step 102). The controller 12 thereafter checks if the packet type is a force link packet (step 103), and if so, the controller generates and sends an accept link packet to the host (124). The source address in the force link packet is the unique address of the host to be linked to the printer, and is stored in printer memory as the destination address for future use at step 100. Once so stored, the printer is now linked to the new host. If the packet is not a force link request packet, the controller 12 checks if the no link flag is set (step 122). If not set, the controller 12 branches to step 104, otherwise, the controller sends a no link response packet to the host having sent the received packet to inform the host that it is not linked to the printer (step 123). The host having received a no link response can link with the printer as described in FIG. 4.

The controller 12 next checks if the packet type read represents a wakeup packet (step 104), or a data packet (step 110). If the packet is a wakeup packet and the printer is able to accept additional data (step 105), the controller 12 sends a ready packet to the host via its RF interface 18 (step 106). If the packet is a wakeup packet and the printer is busy doing another task and unable to accept additional data (step 105), the controller 12 sends a busy packet to the host terminal via RF interface 18 (step 108). If the packet is a data packet (step 110), all the data blocks are read and a checksum is calculated for each block of data (step 112). If all of the checksum values match the checksum values read from the packet (step 113), the controller 12 sends a handshake packet to the host as a positive acknowledgement (step 116), otherwise, no packet is sent to the host terminal (step 114). If the data in the data packet is unframed, or if this is the last packet in a frame, and the frame has been completely received, the controller places the data into a queue in RAM 13 to be processed by the controller 12 (step 120). If a complete data frame is not received, the partial data is held in a temporary buffer in memory of the printer until the remaining data packets in the frame arrive, and the process ends (step 119).

Figure 5B:
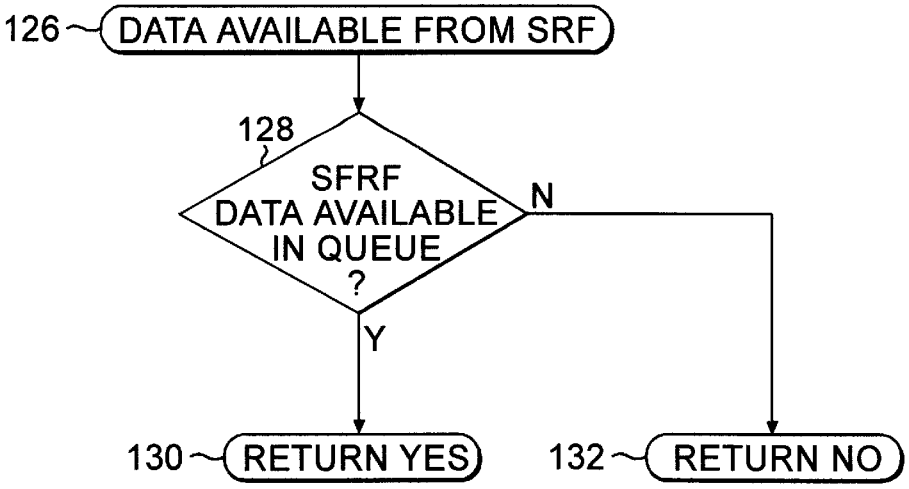
FIG. 5B is a flow chart illustrating the operation and program in the printer to retrieve data from a linked host placed in a queue for processing by the printer.
Figure 7C:
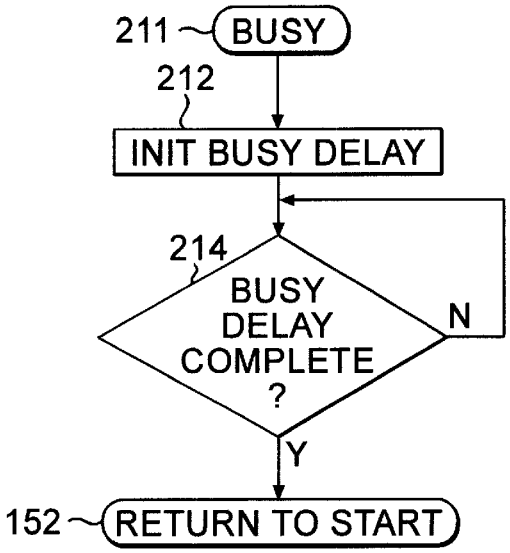
FIGS. 7, 7A, 7B, 7B(*i*)and 7C are connected flow charts illustrating the operation and program in either the host device or printer, or both, to locate a clear channel for RF communication.

Referring to FIG. 5B, step 67 of FIG. 3 is further shown as a subroutine or subprogram in which the printer controller 12 will periodically check if data is available in the queue (step 128), and if so operates responsive to commands and data in the queue to effect printer operation or report on printer status to the host terminal.

Figure 6A:
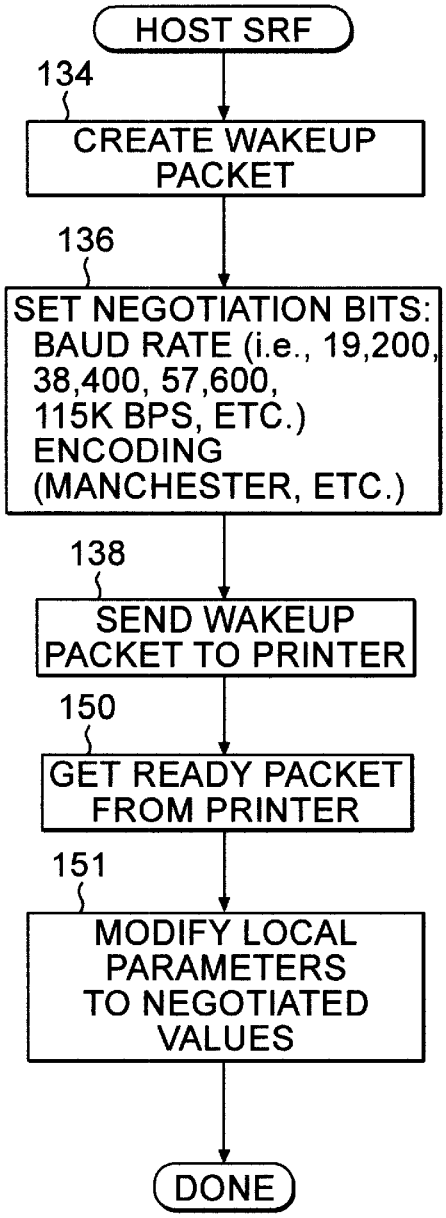
FIG. 6A is a flow chart illustrating the negotiation operation and program in the host device when the wakeup and ready packets of FIGS. 4,5 and 5A utilize negotiation bits.
Figure 6B:
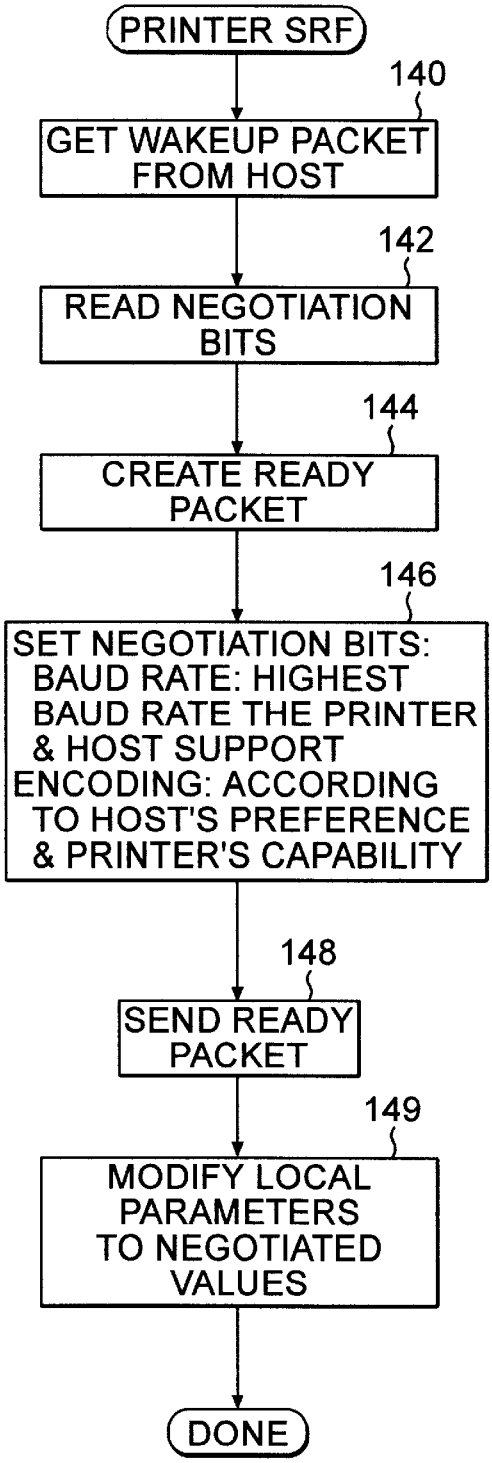
FIG. 6B is a flow chart illustrating the negotiation operation and program in the portable printer of FIG. 1 when the wakeup and handshake packets of FIGS. 4,5 and 5A utilize negotiation bits.

When the portable printer 10 receives a wakeup packet, the packet may include negotiation bits which may be active to indicate the host's capabilities and preferences for communication characteristics, such as baud rate and encoding. FIGS. 6A and 6B shows the operation of the host terminal and printer, respectively, during negotiation. In FIG. 6A, the host creates a wakeup packet with the proper preamble, packet type, source address, and destination address (step 134), and in the packet sets the negotiate bits to indicate the baud rate and encoding format (step 136). For example, one bit may represent whether Manchester encoding is used "0" or not used "1", and five other bits represent the baud rates, e.g., 19.2K, 38.4K, 57.6K, or 115K BPS. The wakeup packet is then sent to the printer via the RF interface of the host terminal (step 138). The printer receives the wakeup packet from the host terminal (step 140), reads the negotiation bits (step 142), and then creates a ready packet with the proper preamble, packet type, source address, and destination address (step 144). In the ready packet, the printer sets its negotiation bits to the highest baud rate both the printer (as determined by parameters in non-volatile memory 37 of the printer) and host supports (as determined by the negotiation bits in the received wakeup packet), and similarly the encoding format according the host's preference and printer's capability (step 146). The printer 10 then sends the ready packet to the host (step 148) and modifies local communication parameters in accordance with the setting of the negotiation bits at step 146 (step 149). Steps 144–148 of FIG. 6B occur at step 106 in FIG. 5, and step 140 of FIG. 6B occurs at step 104 in FIG. 5A. When the host receives the ready packet from the printer (step 150), it modifies local communication parameters in accordance with the setting of the negotiation bits in the ready packet received (step 151). Thus, both the linked printer and host operate in accordance with such negotiated data communication characteristics. This negotiation enables the portable printer 10 to operate with different hosts with different communication characteristics, and similarly can enable the host to operate with different printers with different communication characteristics.

Although one printer is shown in FIG. 1, the data communication system of the present invention may be used in multiple different printers and host terminals (or computer systems) to enable such host terminals to link with different printers.

Referring to FIGS. 7, 7A–7C, a connected flow chart is shown for enabling the host or printer, referred to herein as a device, to determine a clear channel before sending a packet, and thereby reduces the chance of RF transmission collisions between multiple devices. Starting at step 152, the data sending device realizes that it has data to send, i.e., by checking for TX characters in a buffer in memory of the device (step 154) and waiting until such TX characters are ready (step 156). If so, a Recovery flag in memory of the device is set to FALSE value (step 158), and if the device is not a host, i.e., a printer, a first clear channel interval is initialized by starting a timer in the controller of the device and recording the initial value of a RX character counter (step 162). The timer and RX character counter may be a software based timer and counter programmed in the controller. The first clear channel interval may be, for example, 240 milliseconds. The device then checks if a maximum delay has been exceeded on this timer (step 166). This maximum delay may be for example, 10 seconds. If the maximum delay is exceeded, the TX characters in the TX buffer are flushed, i.e., cleared (step 165), and the process restarts at step 152. If the maximum delay has not been exceeded, the device counts the number of RX character present in the channel by listening to the channel, via its RF interface, over the first clear channel interval (steps 167–168). If the RX character count is less than a threshold value (step 170), such as for example, 10 characters, the device checks if more TX characters have been added to TX buffer since the buffer was last checked (step 172). If the RX character count is equal to or greater than the threshold, or more TX characters have been added, the clear channel interval is reinitialized at step 162, and steps 166–172 are repeated.

Figure 7:
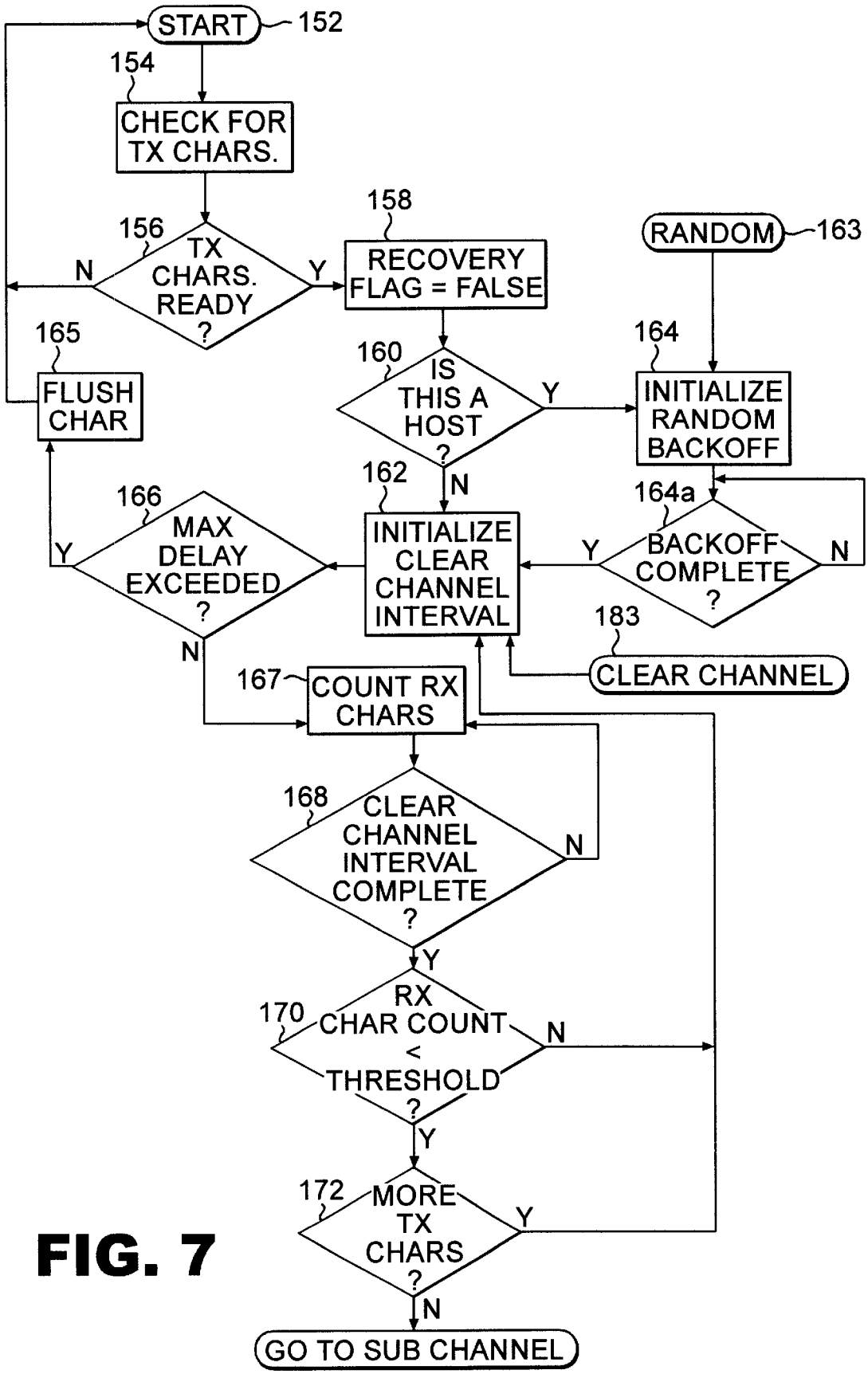
Figure 7A:
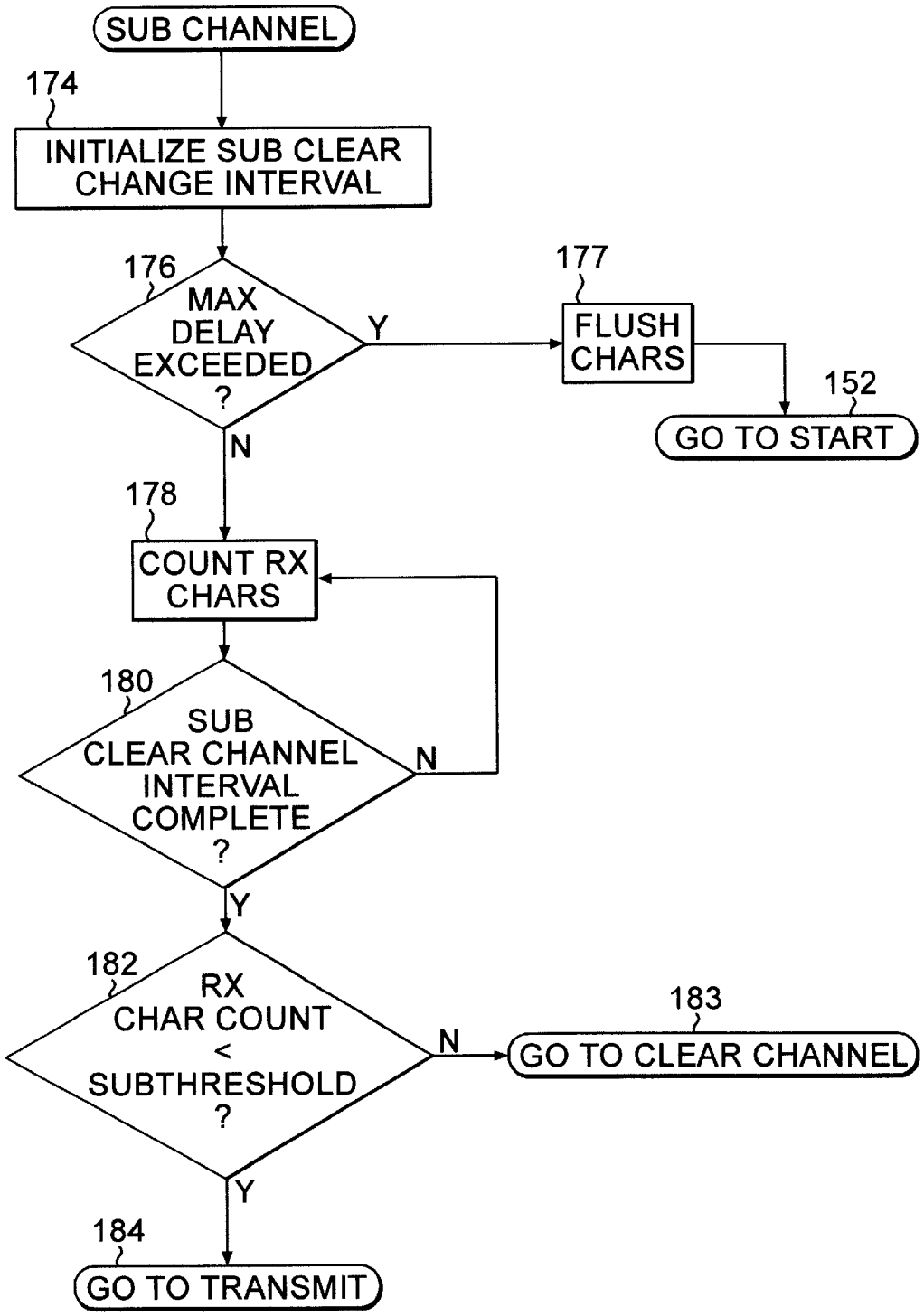

If the RX character count is less than the threshold at step 170, and no more TX characters have been added to the buffer at step 172, the device continues to step 174 of FIG. 7A to check whether a subchannel is clear (step 174–182). These steps 174–182 operate the same as steps 162–170, respectively, using a second subchannel clear interval, rather than the first clear channel interval. The subchannel clear interval may be, for example, 20 milliseconds. If at step 182, the RX character count at step 178 is greater than or equal to a subthreshold number of character, the device branches to step 162 (FIG. 7), via connecting circle 183, otherwise, the device branches to step 184 of FIG. 7B, via connecting circle 184. For example, this subthreshold may be 2 characters.

Figure 7B:
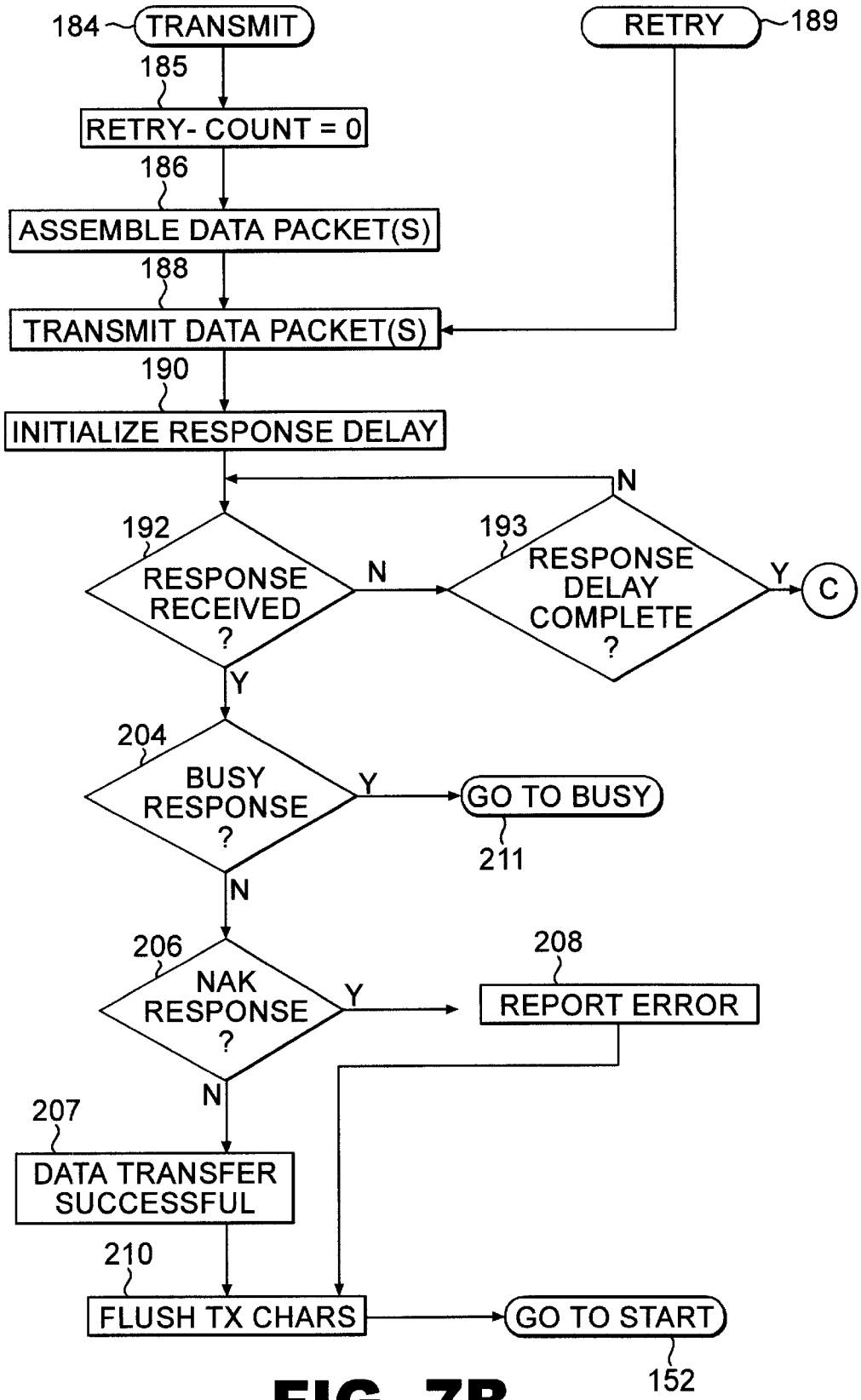
Figure 7B:
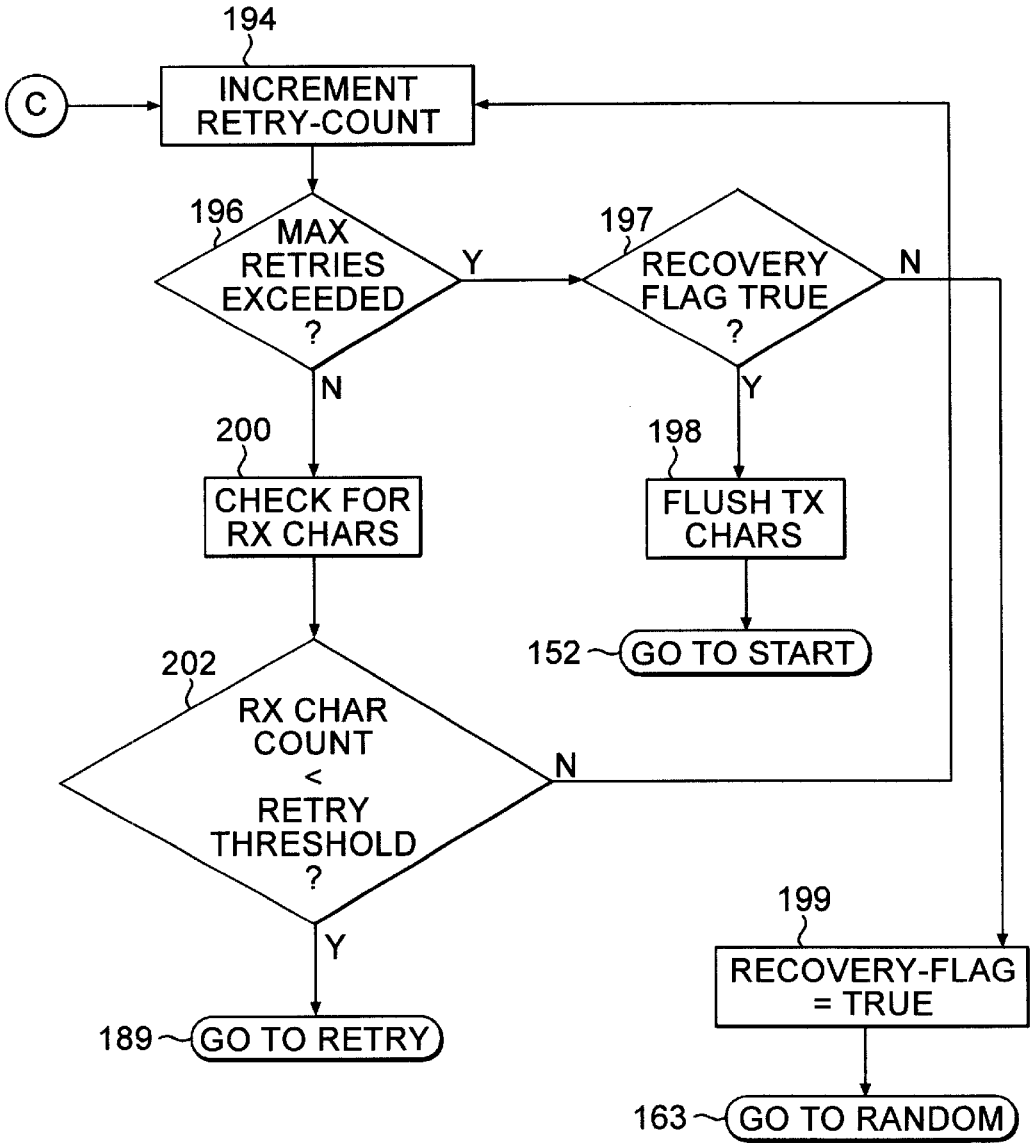

In FIGS. 7B and 7B(*i*), having found a clear channel, the device sets a Retry-count variable in memory of the device to zero (step 185) and assembles the TX characters in a packet (step 186). If multiple packets are ready for transmission in the TX buffer, the device assembles each of the packets for transmission. The packet or packets are then transmitted via the RF interface and radio (antenna) of the device (step 188). Another software timer is then initialized to time the response delay to determine when a maximum response delay has been exceeded (completed) if no response to the transmission is received by the device (steps 190, 192, and 193). For example, the maximum response delay may be 120 milliseconds. If a response packet is received representing a busy packet (step 204), the device branches to step 212, via connecting circle 211. At step 212 of FIG. 7C, another software timer is initialized which when exceeds a busy delay (step 214), such as 2 seconds, returns to step 152. A busy packet is sent by a receiving device when the device cannot operate in response to the packet. Referring back to FIG. 7B, if the response received was a NAK (no-acknowledgement) response (step 206), the error is reported to the user of the device (step 208), via display or LEDs of the device, the TX characters in the TX buffer are flushed (step 210), and the process restarts at step 152. The busy and NAK packets may be sent by either a host or printer. If the response is neither a busy, nor a NAK packet, then the data transfer is successful (step 207), the TX characters in the TX buffer are flushed (step 210), and the process restarts at step 152.

If no response is received by the maximum response delay at step 193, the Retry count variable is incremented by one (step 194), and the device checks if a maximum number of retries has been exceeded (step 196). For example, the maximum number of retries may be five. If not exceeded, the device checks for RX characters in the channel (step 200) and checks if the number of RX characters count is less than a retry threshold, which, for example, may be 5 characters (step 202). This double checks that the channel is still clear. If the RX character count is equal to or greater than the retry threshold, the retry count in incremented (step 194) and steps 196, 200 and 202 are repeated. If a maximum number of retires has been exceeded at step 196, the device checks if the Recovery Flag is set to TRUE, and if so, flushes the TX characters in the TX buffer (step 198) and the process is restarted at step 152. If the Recovery Flag is not TRUE, it is set to TRUE (step 199), and the branch to step 164 FIG. 7 is taken, via connected circle 163. However, if the channel is still available at step 202, i.e., the RX character count is less than the retry threshold, the branch to step 188 is taken, via connected circle 189, to retransmit the packet or packets.

Referring back to FIG. 7, if the device is a host at step 160, another software timer in the controller of the host is initialized and a random backoff time is determined (step 164). When this timer has exceeded the random backoff time (step 164*a*), step 162 is commenced. The random backoff may be based on a random number seed, and may be, for example, a time interval between 20 and 400 milliseconds. This provides a delay interval when another host may be using the channel, such that multiple hosts starting at the same time will be put into a random serial order. This backoff is not required for a printer. Although multiple software timers are described, the software timers may be reused as needed by the controller of the device.

In this manner, once a device has determined that a clear channel exists, it takes control of the channel, and owns it for the entire transaction, i.e., a transmitted packet and a reply packet in response to the transmitted packet from a destination device (such as ready, handshake, or busy packet). The data receiving device is not concerned with establishing a clear channel during the transaction, as the data receiving device sends its reply packets immediately in response to a received packet.

As described above, for a device to begin transmitting, two events must occur. First, clear channel must be detected (steps 167–170 and 178–182), and second, the device must be sure that all of the data to be transmitted is ready (step 172). The clear channel detection has two parts. In each part, an interval is timed and the number of characters received by the radio during the interval is counted. If the number of characters exceeds a threshold (step 170), then the channel is busy. The purpose of the threshold is to allow a certain amount of background noise to be ignored. In the first part (steps 162 and 166–172), a relatively long first interval is timed and a fairly high noise threshold is used. The length of the first interval is chosen so that no device can determine a clear channel during a normal transmitting gap in a typical RF transaction. The second part (steps 174–182), a very short second interval is timed and a very low noise threshold (subthreshold) is used. The second interval should be as short as possible given the accuracy of the device time base.

The purpose of this second interval is to detect transmission that started at the very end of the first interval. The long first interval is repeated until a clear interval is found at which time the short second interval begins. If the short second interval detects anything, the process returns back to the long first interval. Only when a clear long first interval is followed by a clear short second interval are detected does a clear channel exist.

Subject to the limitations, such as the accuracy of the device, the clear channel process will reduce collisions in RF transmissions of multiple devices, however, collisions may occur where two devices are transmitting at the same time. Accordingly, the clear channel process also includes a feature that allows a recovery from a collision a number of retry attempts (steps 194–202), before surrendering the channel and restarting after a random backoff period (steps 164–164*a*). If, after detecting a clear channel, the device transmits but receives a busy response from the destination device, the sending device waits a fixed delay (steps 212–214) for the busy to clear and then restarts the process from the beginning.

Although determination of clear channel is preferred, the host can operate without determination of a clear channel, or instead by repeated transmission of a packet a set number of times until the printer responds with an appropriate handshake packet.

From the foregoing description, it will be apparent that there has been provided an improved data communication system between a portable printer and a host terminal or computer system. Variations and modifications in the herein described system in accordance with the invention will undoubtedly suggest themselves to those skilled in the art. Accordingly, the foregoing description should be taken as illustrative and not in a limiting sense.

What is claimed is:

1. A system for RF communication between a host provided by a computer system or terminal, and a portable printer, said system comprising:

at least one host having means for communication by RF signals;

at least one portable printer comprising means for communicating with said host by RF signals to said communication means of said host; and means for linking said host with said portable printer to enable RF communication there between via said communication means of said host and said communication means of said printer, wherein said linking means comprises means for reading an optical or RF identifier representative of said printer to enable said host to address said printer in RF communication.

2. A system for RF communication between a host device provided by a computer system or terminal, and a portable printer, said system comprising:

at least one host device having means for communication by RF signals;

at least one portable printer having printing means, means for communicating with said host device by RF signals to said communication means of said host device, and means for controlling said printing means and said communication means of said printer; and means for linking said host device with said portable printer to enable RF communication there between via said communication means of said host and said communication means of said printer in which said controlling means of the printer is capable of operating responsive to communications received from said linked host device until another one of said host device links with said printer, wherein said portable printer is associated with a unique identifier and address, said portable printer has a housing having thereupon a barcode representing said identifier, and said linking means of said host device further comprises an optical barcode scanner for reading said barcode, and means for identifying the address of the printer by association of said identifier of said read barcode with the address of said printer.

3. A system for RF communication between a host device provided by a computer system or terminal, and a portable printer, said system comprising:

at least one host device having means for communication by RF signals;

at least one portable printer having printing means, means for communicating with said host device by RF signals to said communication means of said host device, and means for controlling said printing means and said communication means of said printer; and means for linking said host device with said portable printer to enable RF communication there between via said communication means of said host and said communication means of said printer in which said controlling means of the printer is capable of operating responsive to communications received from said linked host device until another one of said host device links with said printer, wherein said portable printer is associated with a unique identifier and address, said portable printer has a housing having an RFID tag coupled to said housing having at least said unique identifier, and said linking means of said host device further comprises a RFID tag reader for reading said RFID tag, and means for identifying the address of the printer by association of said identifier of said read RFID tag with the address of said printer.

4. The system according to claim 2 wherein said linking means further comprises:

means for sending from said host to said printer a first packet having at least said printer address of said printer;

means, responsive said first packet, for sending from said printer to said host device a second packet indicating that the printer is ready to respond to the host;

means, responsive said second packet, for sending from said host to said printer a third packet having at least a host address of said host device to direct the printer to link with the host;

means, responsive said third packet, for sending from said printer to said host device a fourth packet indicating acceptance of the link with the host; and means for sending from said host to said printer one or more data packets with information to be printed by said printing means in accordance with said host address and printer address.

5. The system according to claim 4 wherein said printer has a single printer address and at least one group address associated with a group of different ones of said printer.

6. The system according to claim 3 wherein said linking means further comprises:

means for sending from said host to said printer a first packet having at least said printer address of said printer;

means, responsive said first packet, for sending from said printer to said host device a second packet indicating that the printer is ready to respond to the host;

means, responsive said second packet, for sending from said host to said printer a third packet having at least a host address of said host device to direct the printer to link with the host;

means, responsive said third packet, for sending from said printer to said host device a fourth packet indicating acceptance of the link with the host; and means for sending from said host to said printer one or more data packets with information to be printed by said printing means in accordance with said host address and printer address.

7. The system according to claim 6 wherein said printer has a single printer address and at least one group address associated with a group of different ones of said printer.

8. A system for RF communication between a host device provided by a computer system or terminal, and a portable printer, said system comprising:

at least one host device having means for communication by RF signals;

at least one portable printer having printing means, means for communicating with said host device by RF signals to said communication means of said host device, and means for controlling said printing means and said communication means of said printer; and means for linking said host device with said portable printer to enable RF communication there between via said communication means of said host and said communication means of said printer in which said controlling means of the printer is capable of operating responsive to communications received from said linked host device, wherein linking means comprises means for said printer to broadcast at least one link request packet to at least one of said host device in proximity, in which said one of said host device responds to said link request packet to enable said host device to be linked to said printer.

9. The system according to claim 1 wherein said communication means of said host further comprises:

a RF communication system capable of attaching to said host comprising means for connecting to said host, means for RF communication with said printer, and means for controlling said RF communication means of said RF communication system responsive to said host to enable said linking means.

10. The system according to claim 1 where said linking means comprises means for negotiating transmission characteristics of said communication means of said host and said communication means of said printer.

11. The system according to claim 10 wherein said characteristics represent one of baud rate and encoding format.

12. The system according to claim 1 wherein said communication means in said host further comprises means for establishing a clear channel for sending data to the printer.

13. The system according to claim 1 wherein said communication means in said printer further comprises means for establishing a clear channel for sending data to the host.

14. A method for RF communication between a host provided by a computer system or terminal and a portable printer comprising the step of:

linking said host with said portable printer to enable RF communication between said host and said printer, wherein said linking step comprises the step of reading an optical or RF identifier representative of said printer to enable said host to address said printer in RF communication.

15. A method for RF communication between a host device provided by a computer system or terminal, having an RF communication means and a portable printer having an RF communication means, said method comprising the steps of:

linking said host device with said portable printer to enable RF communication there between via said communication means of said host and said communication means of said printer;

operating said printer responsive to RF communications received from said linked host device until another one of said host device links with said printer; and identifying the address of the printer by association of an identifier one of a read barcode and RFID tag associated with said printer representative of the address of said printer.

16. The method according to claim 15 further comprising the steps of:

sending from said host to said printer a first packet having at least said printer address of said printer;

sending, responsive said first packet, from said printer to said host device a second packet indicating that the printer is ready to respond to the host;

sending, responsive said second packet, from said host to said printer a third packet having at least a host address of said host device to direct said printer to link to said host of said host address;

sending, responsive said third packet, from said printer to said host device a fourth packet indicating acceptance of the link with the host; and sending from said host to said printer one or more data packets with information to be printed by said printing means in accordance with said host address and printer address.

17. The method according to claim 14 further comprising the step of negotiating transmission characteristics of said communication between said host and said printer.

18. The method according to claim 14 further comprising the step of establishing a clear channel for sending data from said printer to said host.

19. The method according to claim 14 further comprising the step of establishing a clear channel for sending data from said host to said printer.

20. A method for RF communication between a host device provided by a computer system or terminal, having an RF communication means and a portable printer having an RF communication means, said method comprising the steps of:

linking said host device with said portable printer to enable RF communication there between via said communication means of said host and said communication means of said printer;

operating said printer responsive to RF communications received from said linked host device until another one of said host device links with said printer; and broadcasting from said printer a link request to one or more hosts, in which one of said hosts responds to said link request to enable said host to be linked to said printer.

21. The system according to claim 1 wherein said printer has an address and said read identifier is associated in said host with said address.

22. The system according to claim 8 wherein said link request packet comprises at least an address associated with said printer.

23. The method according to claim 14 wherein said information represents an address of the printer, and said method further comprising the steps of:

sending from said host to said printer a packet having at least said address of said printer;

sending from said printer to said host a packet indicating that the printer is ready to respond to the host;

sending from said host to said printer a packet having at least a host address of said host to direct said printer to link to said host of said host address;

sending from said printer to said host a packet indicating acceptance of the link with the host; and sending from said host to said printer one or more data packets with information to be printed by said printing means in accordance with said host address and printer address.

24. The method according to claim 20 wherein said link request packet comprises at least an address associated with said printer.

25. A system for RF communication between a host terminal or computer system and a portable printer comprising:

at least one host having means for communication by RF signals;

at least one portable printer having printing means, means for communicating with said host by RF signals to said communication means of said host, and means for controlling said printing means and said communication means of said printer; and means for linking said host with said portable printer to enable RF communication there between via said communication means of said host and said communication means of said printer in which said controlling means of the printer is capable of operating responsive to communications received from said linked host, in which said linking means enables an identifier representative of said printer to be manually inputted at said host to enable said host to address said printer in RF communication.

* * * * *

UNITED STATES PATENT AND TRADEMARK OFFICE

CERTIFICATE OF CORRECTION

PATENT NO. : 6,379,058 B1 
DATED : April 30, 2002
INVENTOR(S) : Steven F. Petteruti et al.

It is certified that error appears in the above-identified patent and that said Letters Patent is hereby corrected as shown below:

Title page,
Item [73], Assignee should read -- ZIH Corp., a Delaware Corporation with it's principal office in Hamilton, Bermuda. --

Signed and Sealed this

Fourth Day of November, 2003

JAMES E. ROGAN
*Director of the United States Patent and Trademark Office*